US011303024B2

(12) United States Patent
Teng

(10) Patent No.: US 11,303,024 B2
(45) Date of Patent: Apr. 12, 2022

(54) ANTENNA STRUCTURE

(71) Applicants: Inventec (Pudong) Technology Corporation, Shanghai (CN); INVENTEC CORPORATION, Taipei (TW)

(72) Inventor: Pei-Ling Teng, Taipei (TW)

(73) Assignees: Inventec (Pudong) Technology Corporation, Shanghai (CN); INVENTEC CORPORATION, Taipei (TW)

( * ) Notice: Subject to any disclaimer, the term of this patent is extended or adjusted under 35 U.S.C. 154(b) by 0 days.

(21) Appl. No.: 17/013,678

(22) Filed: Sep. 7, 2020

(65) Prior Publication Data

US 2022/0069469 A1 Mar. 3, 2022

(30) Foreign Application Priority Data

Aug. 25, 2020 (CN) ..... 202010860781.7

(51) Int. Cl.

| | |
|---|---|
| ***H01Q 1/36*** | (2006.01) |
| ***H01Q 5/15*** | (2015.01) |
| ***H01Q 5/30*** | (2015.01) |
| ***H01Q 5/371*** | (2015.01) |
| ***H01Q 9/04*** | (2006.01) |

(52) U.S. Cl.

CPC ..... *H01Q 5/371* (2015.01); *H01Q 9/0421* (2013.01); *H01Q 9/0442* (2013.01)

(58) Field of Classification Search

CPC ..... H01Q 5/371; H01Q 9/0421; H01Q 9/0442

See application file for complete search history.

(56) References Cited

U.S. PATENT DOCUMENTS

| | | | | |
|---|---|---|---|---|
| 2011/0037672 | A1* | 2/2011 | Tseng | H01Q 9/0421 343/767 |
| 2012/0306709 | A1* | 12/2012 | Wu | H01Q 5/371 343/767 |
| 2013/0201062 | A1* | 8/2013 | Lin | H01Q 1/243 343/702 |
| 2013/0234903 | A1* | 9/2013 | Kwak | H01Q 1/243 343/750 |
| 2015/0061951 | A1* | 3/2015 | Wong | H01Q 5/371 343/749 |

FOREIGN PATENT DOCUMENTS

| | | |
|---|---|---|
| TW | M367432 U | 10/2009 |
| TW | I327389 B | 7/2010 |

* cited by examiner

*Primary Examiner* — Hai V Tran
*Assistant Examiner* — Michael M Bouizza
(74) *Attorney, Agent, or Firm* — CKC & Partners Co., LLC

(57) ABSTRACT

An antenna structure includes a h-shaped radiator and a first radiator. The h-shaped radiator has a first segment, a second segment opposite to the first segment, a first end and a second end which are located at the first segment, a third end located at the second segment, a short-circuit point at the first segment, and a feeding point at the second segment, in which the first segment is longer than the second segment. The first radiator is connected to the second segment.

13 Claims, 9 Drawing Sheets

ANTENNA STRUCTURE

CROSS-REFERENCE TO RELATED APPLICATION

This application claims priority to China Application Serial Number 202010860781.7, filed Aug. 25, 2020, which is herein incorporated by reference in its entirety.

BACKGROUND

Field of Invention

The present disclosure relates to an antenna, and more particularly, to a multi-band antenna.

Description of Related Art

At present, communication technology is widely used in various fields. Moreover, communication technology has gradually matured.

In order to achieve communication technology that is rich and versatile, antennas need to be applied in different frequency bands. However, the space in the communication device in which the antennas are disposed is limited. Additionally, if various different types of antennas are disposed in a communication device, it is even more necessary to design the antennas to occupy less space.

Accordingly, research in various industries has been focused on ways to develop a multi-band antenna which can be applied in different frequency bands and which occupies less space.

SUMMARY

An aspect of the disclosure is to provide an antenna module which can effectively solve the aforementioned problems.

According to some embodiments of the present disclosure, an antenna structure includes a h-shaped radiator and a first radiator. The h-shaped radiator has a first segment, a second segment opposite to the first segment, a first end and a second end which are located at the first segment, a third end located at the second segment, a short-circuit point at the first segment, and a feeding point at the second segment, in which the first segment is longer than the second segment. The first radiator is connected to the second segment.

According to some embodiments of the present disclosure, the short-circuit point and the first end are separated by a first distance in an axial direction parallel to the first section, a first ratio of the first distance to a length of the antenna structure in the axial direction is from 3:20 to 1:5, and the feeding point is separated from the first end by a second distance in the axial direction, a second ratio of the second distance to the length is from 3:10 to 7:20.

According to some embodiments of the present disclosure, the antenna structure further includes a conductive foil connected to the first segment of the first h-shaped radiator.

According to some embodiments of the present disclosure, the first radiator is U-shaped and includes a first segment and a second segment corresponding to the first segment, the first segment of the first radiator is spaced apart with and corresponding to the first segment of the h-shaped radiator, and the second segment of the first radiator is connected to the second segment of the h-shaped radiator.

According to some embodiments of the present disclosure, the antenna structure further comprises a rectangular radiator connected to a position where the h-shaped radiator joins the first radiator, in which a long side of the rectangular radiator is parallel to the first section of the h-shaped radiator.

According to some embodiments of the present disclosure, the h-shaped radiator and the first radiator collectively form a planar structure.

According to some embodiments of the present disclosure, the antenna structure further includes a sidewall radiator, in which the sidewall radiator is located at an edge extending through the h-shaped radiator and the first radiator.

According to some embodiments of the present disclosure, the antenna structure includes a connector and a second radiator, in which the second radiator is parallel to the h-shaped radiator, and the connector is connected between the h-shaped radiator and the second radiator.

According to some embodiments of the present disclosure, the second radiator is rectangular or U-shaped.

According to some embodiments of the present disclosure, the antenna structure further includes a tuning circuit connected between the first and second segments of the h-shaped radiator.

According to some embodiments of the present disclosure, the antenna structure further includes a tuning circuit connected between the second segment of the h-shaped radiator and the first radiator.

In summary, the antenna structure includes a h-shaped radiator to provide multiple resonant frequency modes, and thus the antenna structure can be applied in multiple operating bands such as high-frequency operating bands. In addition, the h-shaped radiator is connected to a second radiator via a connector to collectively form a stacked structure. A sidewall radiator of the antenna structure can increase radiating area to adjust low frequency impedance and widen the low frequency operating bands thereof. Moreover, tuning circuits can be located on the h-shaped radiator, and thus the antenna structure can be applied in multiple operating frequency bands, increase the isolation therein, and miniaturize to decrease the occupied volume thereof.

It is to be understood that both the foregoing general description and the following detailed descriptions are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
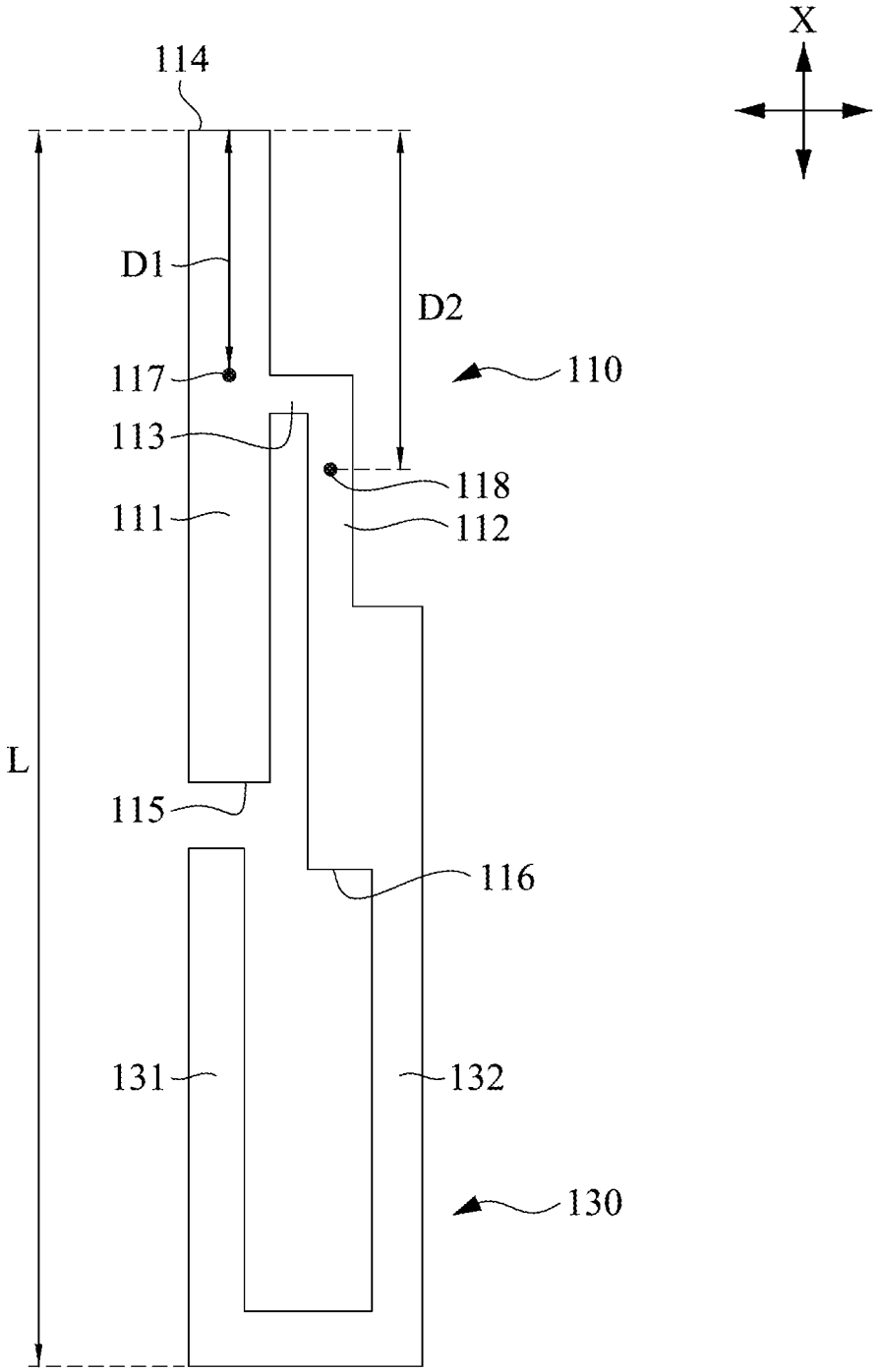
FIG. 1 through FIG. 3 respectively illustrate top views in accordance with some embodiments of the present disclosure.

Reference will now be made in detail to the present embodiments of the disclosure, examples of which are illustrated in the accompanying drawings. Wherever possible, the same reference numbers are used in the drawings and the description to refer to the same or like parts.

In various embodiments, description is made with reference to figures. However, certain embodiments may be practiced without one or more of these specific details, or in combination with other known methods and configurations. In the following description, numerous specific details are set forth, such as specific configurations, dimensions and processes, etc., in order to provide a thorough understanding of the present disclosure. Reference throughout this specification to "one embodiment," "an embodiment", "some embodiments" or the like means that a particular feature, structure, configuration, or characteristic described in connection with the embodiment is included in at least one embodiment of the disclosure. Thus, the appearances of the phrase "in one embodiment," "in an embodiment", "in some embodiments" or the like in various places throughout this specification are not necessarily referring to the same embodiment of the disclosure. Furthermore, the particular features, structures, configurations, or characteristics may be combined in any suitable manner in one or more embodiments.

Reference is made to FIG. 1. In an embodiment of the present disclosure, an antenna structure 100 includes a h-shaped radiator 110 and a first radiator 130, in which the h-shaped radiator 110 and the first radiator 130 can be integrally formed. The present disclosure is not limited in this respect. The h-shaped radiator 110 has a first segment 111, a second segment 112 which is opposite to the first segment 111, and a middle segment 113 connected between the first and second segments 111, 112, in which the first and second segments 111, 112 are parallel. Moreover, the h-shaped radiator 110 includes a first end 114 and a second end 115 which are located at the first segment 111 and a third end 116 located at the second segment 112, and the first segment 111 is longer than the second segment 112. The first end 114 is located at a side of the middle segment 113, but the second end 115 and the third end 116 are located on an opposite side thereof. The h-shaped radiator 110 further includes a short-circuit point 117 and a feeding point 118, and the short-circuit point 117 is located at the first segment 111, the feeding point 118 is located at the second segment 112. The first radiator 130 is connected to the second segment 112 of the h-shaped radiator 110. The h-shaped radiator 110 provides an outstanding excitation process, which contributes to multiple resonant frequency modes of other radiators connected to the h-shaped radiator 110. Therefore, the radiators can be used in multiple intermediate resonance frequency bands or high resonance frequency bands.

Specifically, the h-shaped radiator 110 and the first radiator 130 collectively form a planar structure. The h-shaped radiator 110 and the first radiator 130 contain metal materials, such as copper, silver, aluminum, iron or the alloys thereof. The present disclosure is not limited in this respect. The short-circuit point 117 can be electrically connected to a structure having a grounding function, and electromagnetic signals are fed in the h-shaped radiator 110 from the feeding point 118.

The short-circuit point 117 and the first end 114 are spaced apart by a first distance D1 in an axial direction X parallel to the first segment 111, in which a first ratio of the first distance D1 to a length L of the antenna structure 100 in the axial direction X is from about 3:20 to about 1:5. The feeding point 118 is separated from the first end 114 by a second distance D2 in the axial direction X, a second ratio of the second distance D2 to the length L is from about 3:10 to about 7:20. That is, the second distance D2 is a translation distance taken along with the axial direction X from the feeding point 118 to the first end 114. A second ratio of the second distance D2 to the length L of the antenna structure 100 in the axial direction X is from about 3:10 to about 7:20, and the length L is approximately 10 mm. The present disclosure is not limited in this respect.

In addition, the first radiator 130 is U-shaped and includes a first segment 131 and a second segment 132 corresponding to the first segment 131. For instance, the first segment 131 is opposite and parallel to the second segment 132. The first segment 131 of the first radiator 130 is spaced apart from and corresponding to the first segment 111 of the h-shaped radiator 110, and the second segment 132 of the first radiator 130 is connected to the second segment 112 of the h-shaped radiator 110. The connecting relation between the h-shaped radiator 110 and the U-shaped first radiator 130 helps the antenna structure 100 to be applied in multiple operating frequency bands. In some embodiments of the present disclosure, the first and second segments 111, 112 of the h-shaped radiator 110 extend in the axial direction X, and the first and second segments 131, 132 of the U-shaped first radiator also extend in the axial direction X.

Figure 2:
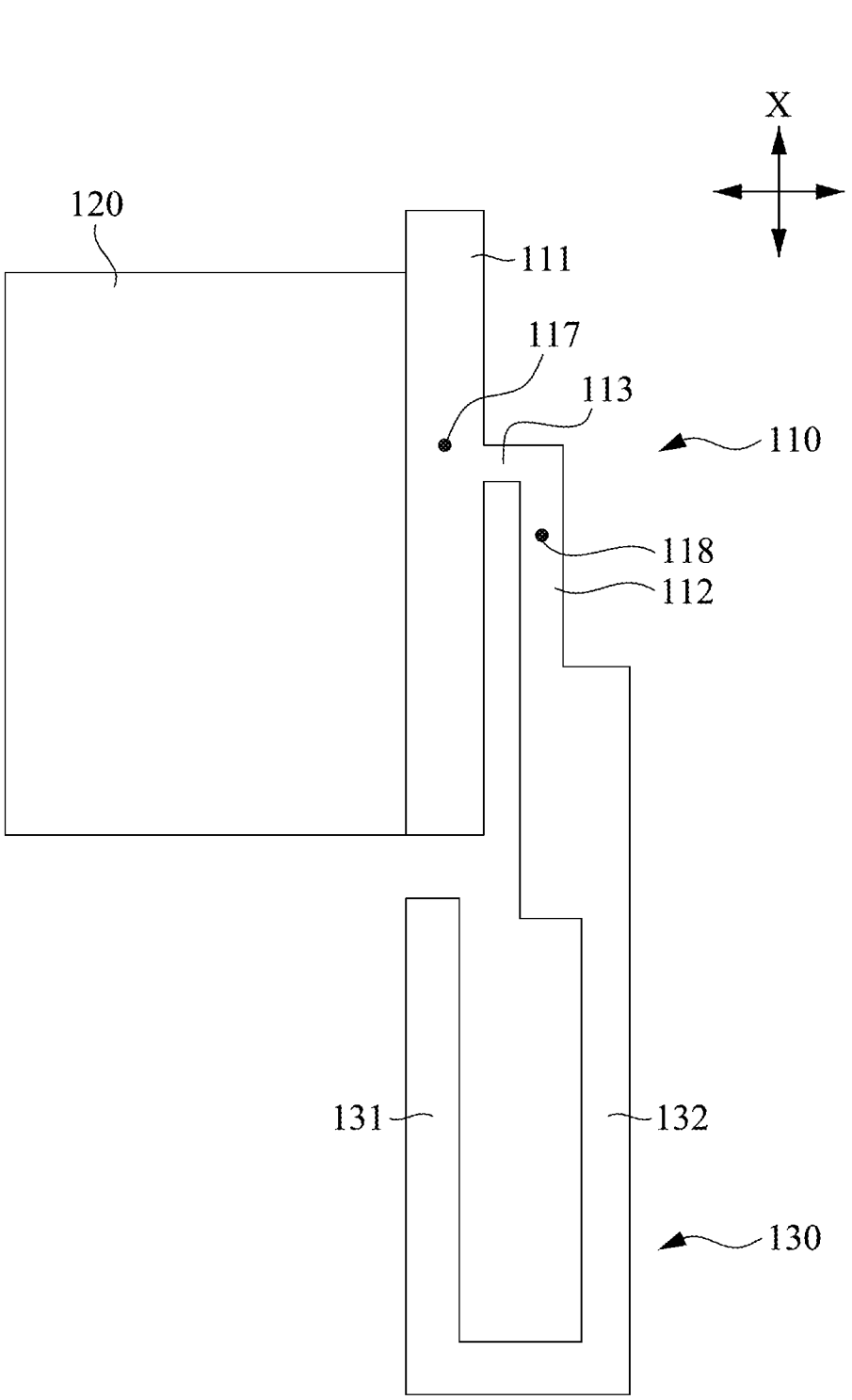

Reference is made to FIG. 2. FIG. 2 illustrates a top view in accordance with some embodiments of the present disclosure. The antenna structure 100 further includes a conductive foil 120 connected to the first segment 111 of the h-shaped radiator 110, and the conductive foil 120 can have a grounding function. Specifically, the conductive foil 120 is connected to a side of the first segment 111 facing away from the second segment 112. In addition, the conductive foil 120 may be copper foil or aluminum foil, and the present invention is not limited in this respect.

Figure 3:
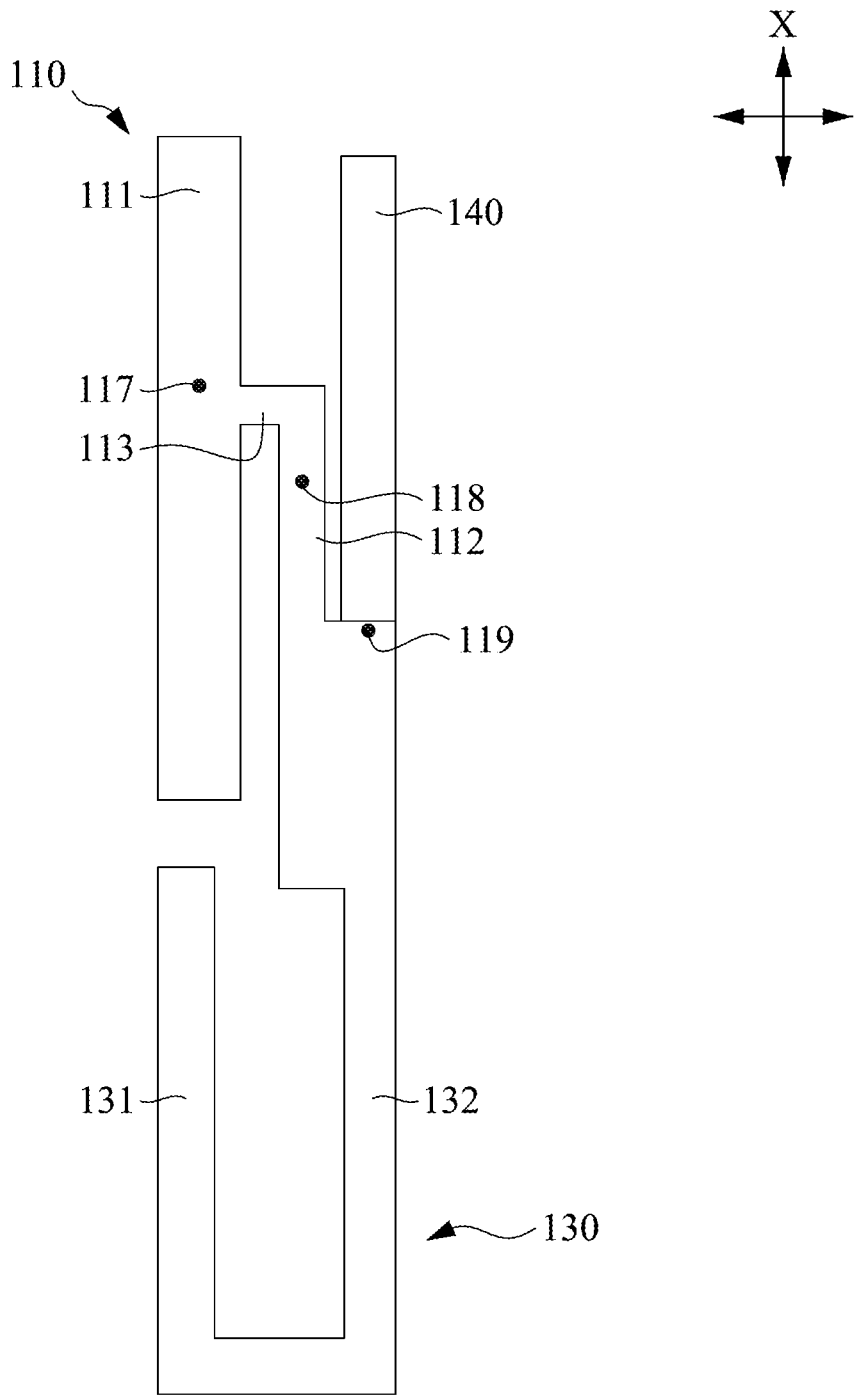

Reference is made to FIG. 3. FIG. 3 illustrates a top view in accordance with some embodiments of the present disclosure. The antenna structure 100 further includes a rectangular radiator 140 connected to a position where the h-shaped radiator 110 joins the first radiator 130. The rectangular radiator 140 has a long side substantially parallel to the first segment 111 of the h-shaped radiator 110. In addition, the h-shaped radiator 110 further includes another feeding point 119, and the feeding point 119 is located at a position adjacent to the rectangular radiator 140, such that the antenna structure 100 can generate more resonant frequency modes.

Figure 4:
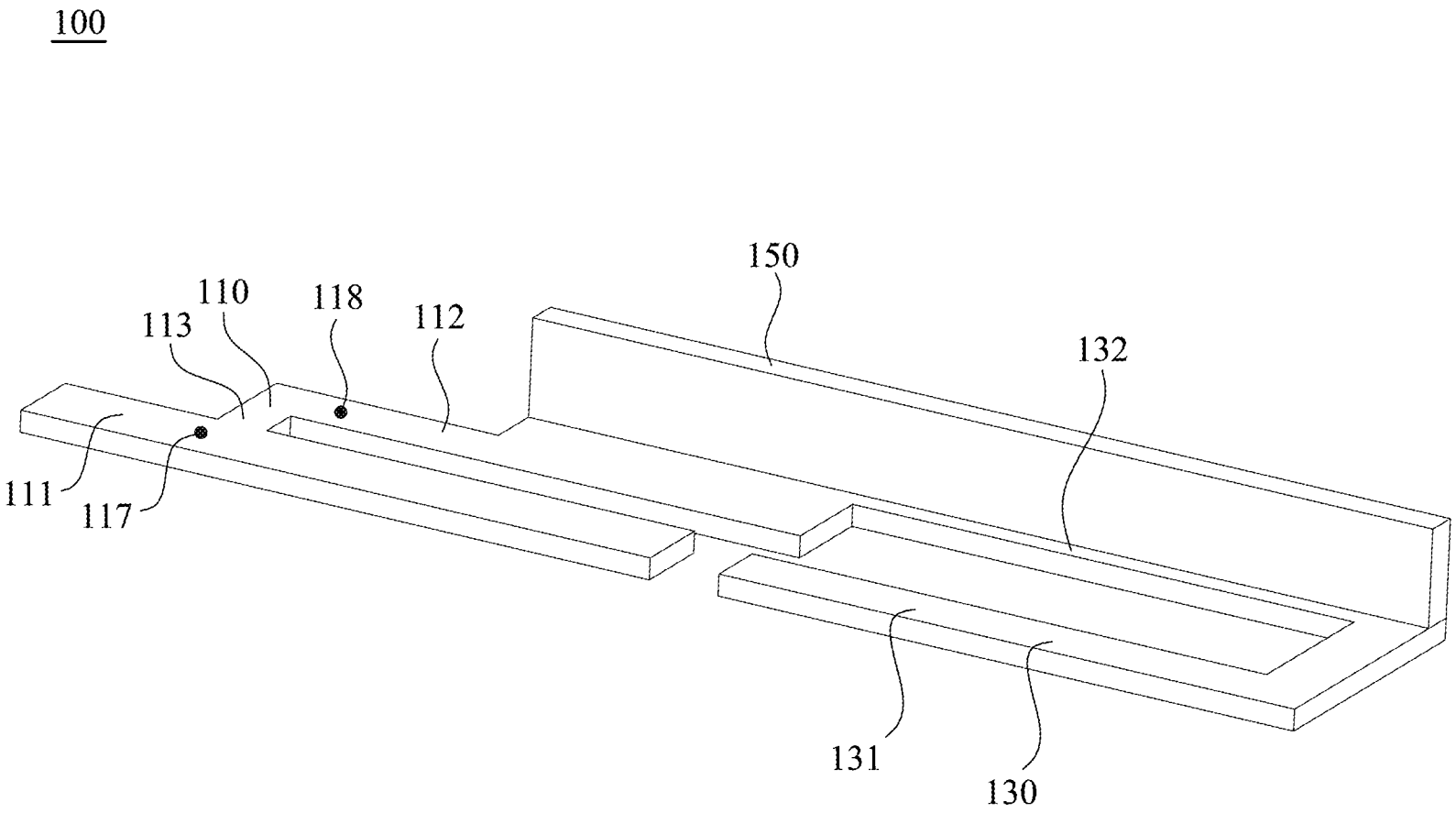
FIG. 4 through FIG. 8 respectively illustrate schematic diagrams in accordance with some embodiments of the present disclosure.

Reference is made to FIG. 4. FIG. 4 illustrates a schematic view in accordance with some embodiments of the present disclosure. The antenna structure 100 further includes a sidewall radiator 150 which is perpendicular to the h-shaped radiator 110. The sidewall radiator 150 is located at an edge where the h-shaped radiator 110 joins the first radiator 130. Specifically, the sidewall radiator 150 is located at the edge of the h-shaped radiator 110 and the first radiator 130 which face away from the first segment 111 of the h-shaped radiator 110. The sidewall radiator 150 can increase radiating area to adjust low frequency impedance and widen the low frequency operating bands.

Figure 5:
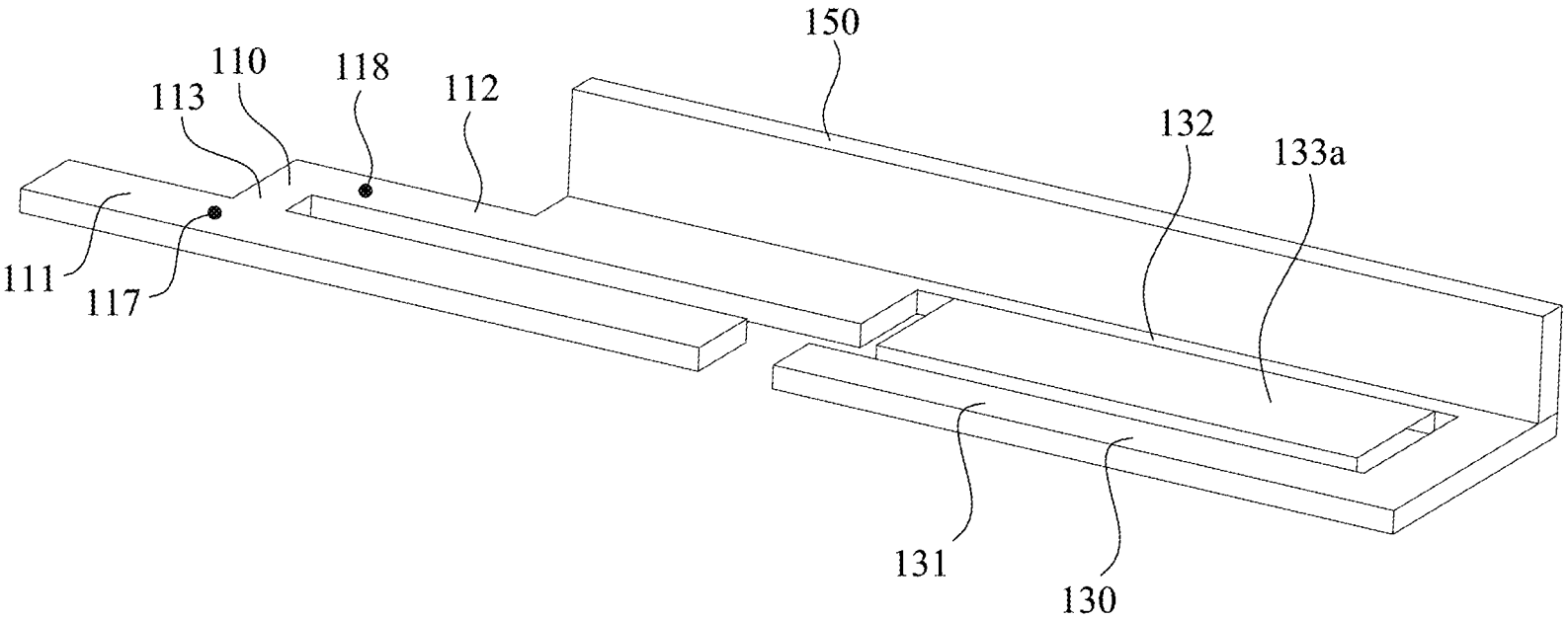

Reference is made to FIG. 5. FIG. 5 illustrates a schematic view in accordance with some embodiments of the present disclosure. The antenna structure 100 further includes an extending structure 133*a* located between the first and second segments 131, 132 of the U-shaped first radiator 130. Specifically, the extending structure 133*a* is rectangular conductor, and the extending structure 133*a* is connected to the second segment 132 in order to widen the resonant frequency bands of the antenna structure 100.

Figure 6:
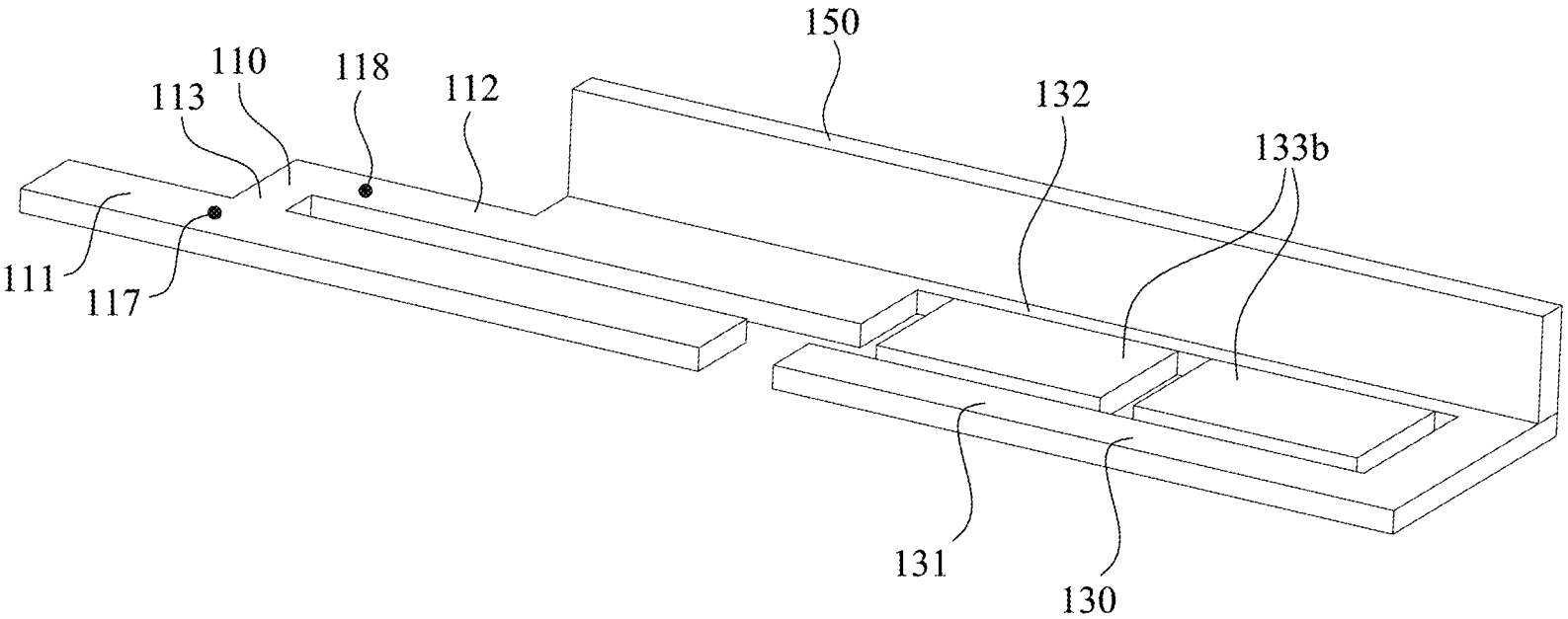

Reference is made to FIG. 6. FIG. 6 illustrates a schematic view in accordance with some embodiments of the present disclosure. The antenna structure 100 further includes two extending structures 133*b* located between the first and second segments 131, 132 of the U-shaped first radiator 130. Specifically, the two extending structures 133*b*, which are rectangular conductors, are spaced apart, and the two extending structures 133*b* are connected to the second segment 132 in order to widen the operating frequency bands of the antenna structure 100.

Figure 7:
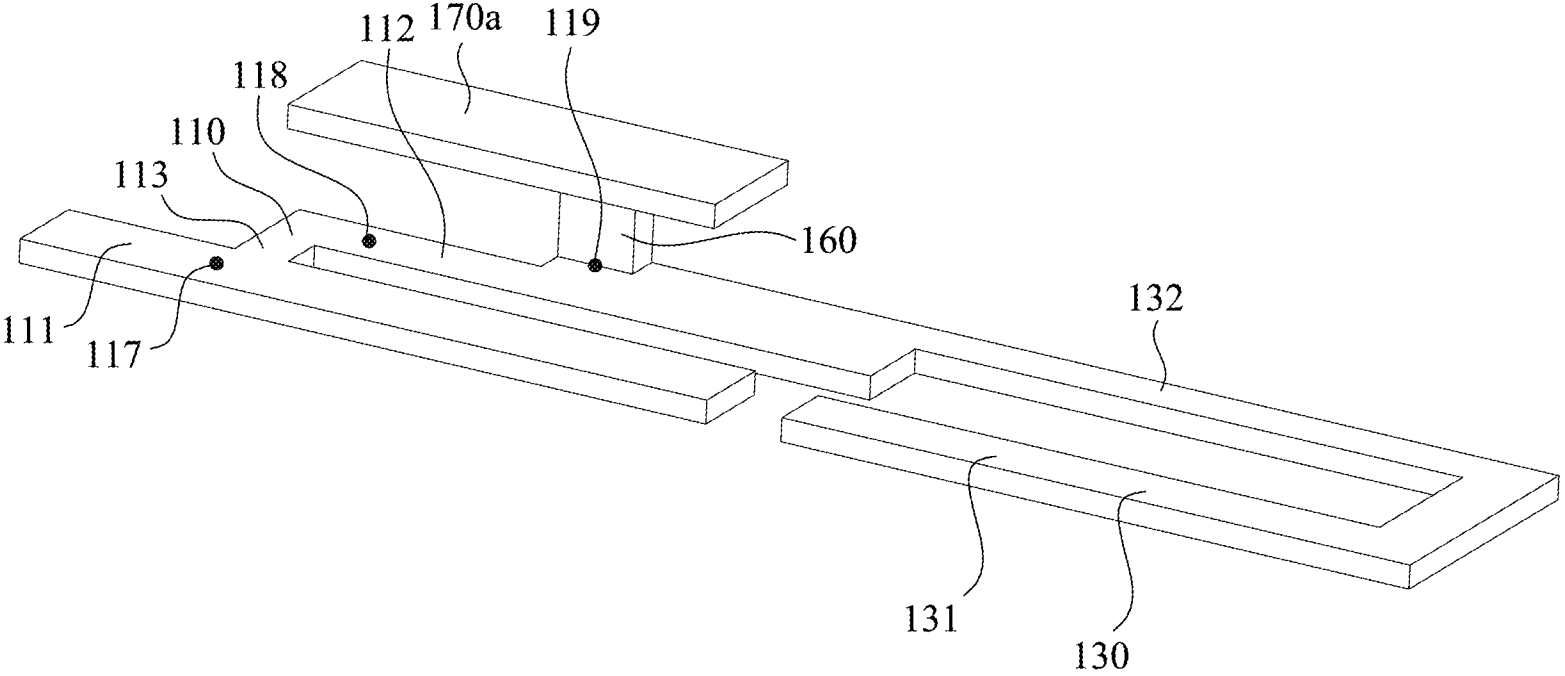

Reference is made to FIG. 7. FIG. 7 illustrates a schematic view in accordance with some embodiments of the present disclosure. The antenna structure 100 includes a connector 160 and a second radiator 170*a*, and the second radiator 170 is parallel to the h-shaped radiator 110. For instance, the h-shaped radiator 110 and the second radiator 170*a* respectively extend along with two parallel planes. The connector 160 is connected between the h-shaped radiator 110 and the second radiator 170*a* in order to collectively form a stacked structure. Specifically, the connector 160 is connected to a second segment 112 of the h-shaped radiator 110. In addition, the h-shaped radiator 110 further includes another feeding point 119 located at a position where the h-shaped radiator 110 joins the connector 160. Specifically, the connector 160 can be a pogo pin or a metal spring, and the second radiator is rectangular. A substrate such as a dielectric substrate can be located between the h-shaped radiator 110 and the second radiator 170*a*. The present disclosure is not limited in this respect.

Figure 8:
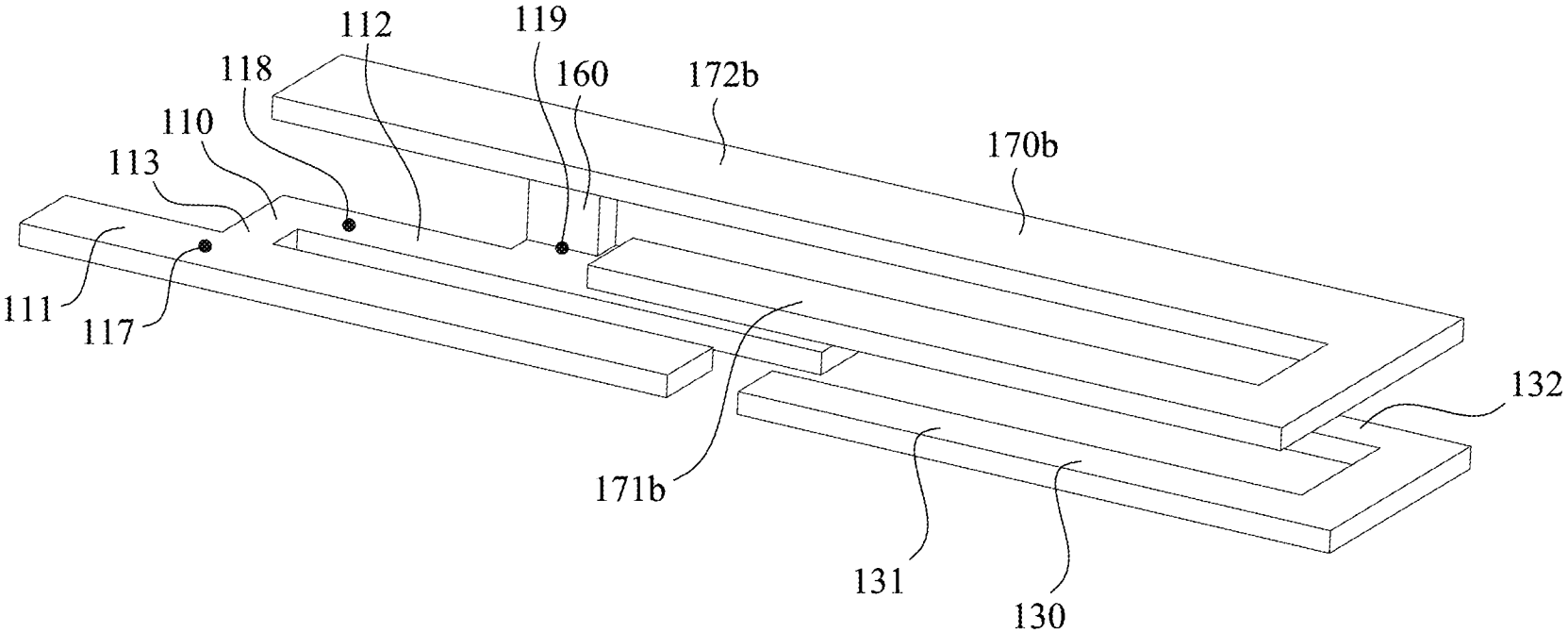

Reference is made to FIG. 8. FIG. 8 illustrates a schematic view in accordance with some embodiments of the present disclosure. FIG. 7 and FIG. 8 are substantially the same, and the main difference is that the second radiator 170*b* is U-shaped in FIG. 8. The U-shaped second radiator 170*b* includes a first segment 171*b* and a second segment 172*b* corresponding to the first segment 171*b*. A vertical projection of first segment 171*b* of the second radiator 170*b* is formed on the first segment 111 of the h-shaped radiator 110 and the first segment 131*b* of the first radiator 130. Moreover, a vertical projection of the second segment 172*b* of the second radiator 170*b* is formed on the second segment 112 of the h-shaped radiator 110 and the second segment 132*b* of the first radiator 130.

Figure 9:
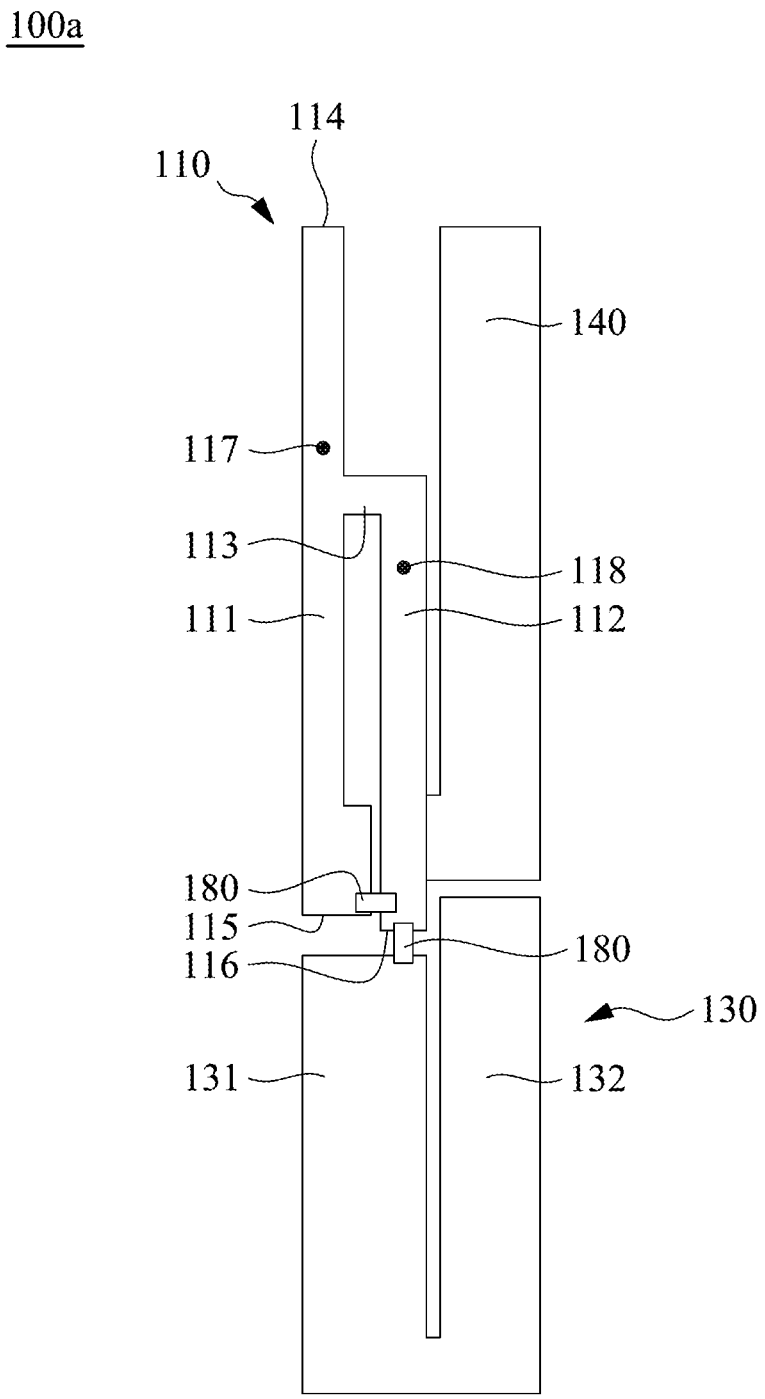
FIG. 9 illustrates a top view in accordance with an embodiment of the present disclosure.

Reference is made to FIG. 9. FIG. 9 illustrates a top view in accordance with some embodiments of the present disclosure. An antenna structure 100*a* includes a h-shaped radiator 110, a first radiator 130, and a tuning circuit 180, in which the tuning circuit 180 can be a capacitor, an inductor, or a resistor. The category of the tuning circuit 180 is selected according to the user's requirements, and the present disclosure is not limited in this respect. For instance, the tuning circuit 180 such as a capacitor is connected between the first and second segments 111, 112 of the h-shaped radiator 110, and the tuning circuit 180 is adjacent to the second and third ends 115, 116 of the h-shaped radiator 110. In some other embodiments, the tuning circuit 180 such as an inductor is connected between the second segment 112 of the h-shaped radiator 110 and the first radiator 130. For instance, the tuning circuit 180 is connected between the second segment 112 of the h-shaped radiator 110 and the first segment 131 of the first radiator 130. The tuning circuit 180 can also be connected between the second segment 112 of the h-shaped radiator 110 and the second segment 132 of the first radiator 130. Specifically, when the tuning circuit 180 is an inductor, the tuning circuit 180 can widen the operating frequency bands of the antenna structure 100. When the tuning circuit 180 is a capacitor, the tuning circuit 180 can provide isolation between radiators. Therefore, the antenna structure 100 can be applied in suitable frequency bands and miniaturized.

In summary, the antenna structure includes a h-shaped radiator to provide multiple resonant frequency modes, and thus the antenna structure can be applied in multiple operating bands such as high-frequency operating bands. In addition, the h-shaped radiator is connected to a second radiator via a connector to collectively form a stacked structure. A sidewall radiator of the antenna structure can increase radiating area to adjust low frequency impedance and widen the low frequency operating bands thereof. Moreover, tuning circuits can be located on the h-shaped radiator, and thus the antenna structure can be applied in multiple operating frequency bands, increase the isolation therein, and miniaturize to decrease the occupied volume thereof.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An antenna structure, comprising:

a h-shaped radiator having a first segment, a second segment opposite to the first segment, a first end and a second end which are located at the first segment, a third end located at the second segment, a short-circuit point at the first segment, and a feeding point at the second segment, wherein the first segment is longer than the second segment, the feeding point is disposed at a portion of the second segment that is in parallel to the first segment; and a first radiator connected to the second segment, wherein the short-circuit point and the first end are separated by a first distance in an axial direction parallel to the first segment, a first ratio of the first distance to a length of the antenna structure in the axial direction is from 3:20 to 1:5, and the feeding point is separated from the first end by a second distance in the axial direction, a second ratio of the second distance to the length is from 3:10 to 7:20.

2. The antenna structure of claim 1, wherein the second radiator is U-shaped.

3. The antenna structure of claim 1, further comprising a conductive foil connected to the first segment of the h-shaped radiator.

4. The antenna structure of claim 1, wherein the first radiator is U-shaped and comprises a first segment and a second segment corresponding to the first segment, the first segment of the first radiator is spaced apart with and corresponding to the first segment of the h-shaped radiator, and the second segment of the first radiator is connected to the second segment of the h-shaped radiator.

5. The antenna structure of claim 1, further comprising a rectangular radiator connected to a position where the h-shaped radiator joins the first radiator, wherein a long side of the rectangular radiator is parallel to the first segment of the h-shaped radiator.

6. The antenna structure of claim 1, wherein the h-shaped radiator and the first radiator collectively form a planar structure.

7. The antenna structure of claim 1, further comprising a sidewall radiator, wherein the sidewall radiator is disposed at an edge extending through the h-shaped radiator and the first radiator.

8. The antenna structure of claim 1, further comprising a connector and a second radiator, wherein the second radiator and the h-shaped radiator respectively extend along with two parallel planes, the connector is connected between the h-shaped radiator and the second radiator.

9. The antenna structure of claim 8, wherein the second radiator is rectangular.

10. The antenna structure of claim 1, further comprising a tuning circuit connected between the first and second segments of the h-shaped radiator.

11. The antenna structure of claim 10, wherein the tuning circuit is an inductor.

12. The antenna structure of claim 1, further comprising a tuning circuit connected between the second segment of the h-shaped radiator and the first radiator.

13. The antenna structure of claim 12, wherein the tuning circuit is a capacitor.

* * * * *